United States Patent [19]

Ernst et al.

[11] 4,390,481

[45] Jun. 28, 1983

[54] APPARATUS FOR SPRAYING TRICKLER PLATES WITH COOLING WATER

[75] Inventors: Günter Ernst, Karlsruhe; Dieter Wurz, Pfinztal, both of Fed. Rep. of Germany

[73] Assignee: Aktiebolag Carl Munters, Sollenguna, Sweden

[21] Appl. No.: 267,995

[22] Filed: May 28, 1981

[30] Foreign Application Priority Data

Jun. 4, 1980 [DE] Fed. Rep. of Germany ..... 3021202

[51] Int. Cl.[3] ..... B01F 3/04

[52] U.S. Cl. ..... 261/112; 261/DIG. 11

[58] Field of Search ..... 261/112, DIG. 11

[56] References Cited

U.S. PATENT DOCUMENTS

| | | | |
|---|---|---|---|
| 1,987,881 | 1/1935 | Von Seggem et al. | 261/112 |
| 2,231,088 | 2/1941 | Richardson | 261/112 |
| 2,610,835 | 9/1952 | Hytte | 261/112 |
| 3,313,533 | 4/1967 | Powers | 261/112 |
| 3,314,664 | 4/1967 | Dummett | 261/112 |
| 3,372,529 | 3/1968 | Harms | 261/112 |
| 3,504,738 | 4/1970 | McGuffey | 261/112 |
| 3,540,702 | 11/1970 | Uyama | 261/112 |
| 3,612,494 | 10/1971 | Toyama | 261/112 |
| 3,963,810 | 6/1976 | Holmberg et al. | 261/112 |
| 3,997,635 | 12/1976 | Hallgren | 261/112 |
| 4,031,180 | 6/1977 | Bohanon | 261/112 |
| 4,272,462 | 6/1981 | Butt | 261/112 |

FOREIGN PATENT DOCUMENTS

| | | | |
|---|---|---|---|
| 461944 | 6/1928 | Fed. Rep. of Germany | 261/112 |
| 462473 | 7/1928 | Fed. Rep. of Germany | 261/112 |
| 1293796 | 4/1969 | Fed. Rep. of Germany | 261/112 |
| 2250912 | 4/1976 | Fed. Rep. of Germany . | |
| 2402181 | 8/1978 | Fed. Rep. of Germany . | |
| 1007340 | 5/1952 | France | 261/112 |
| 520309 | 4/1972 | Switzerland . | |

*Primary Examiner*—Tim R. Miles

*Attorney, Agent, or Firm*—Curtis, Morris & Safford

[57] ABSTRACT

An apparatus for spraying trickler plates with cooling water, particularly in cooling towers, comprises spray channels 7,8 which are formed to be smoothly continuous and which touch or pass through the upper end sections of the trickler plates 1. The trickler plates are provided in the upper areas with a surface pattern 27 for uniform distribution of the cooling water. The spraying apparatus avoids a spacing between the spray channels and the trickler plates and provides for easy manufacture maintenance, particularly for an easy cleaning of the spray channels 7,8 (FIG. 5).

7 Claims, 8 Drawing Figures

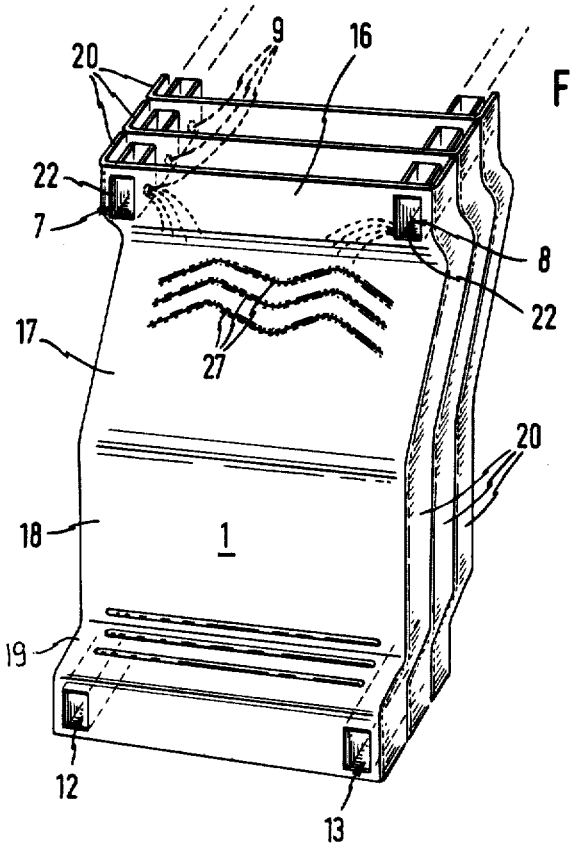
FIG. 5
FIG. 8
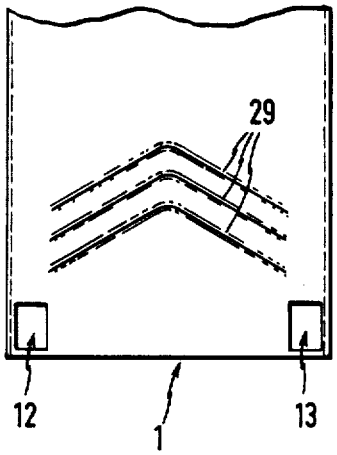
FIG. 7
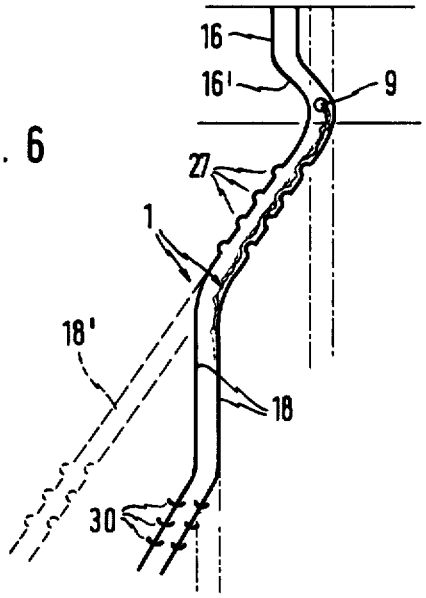
FIG. 6
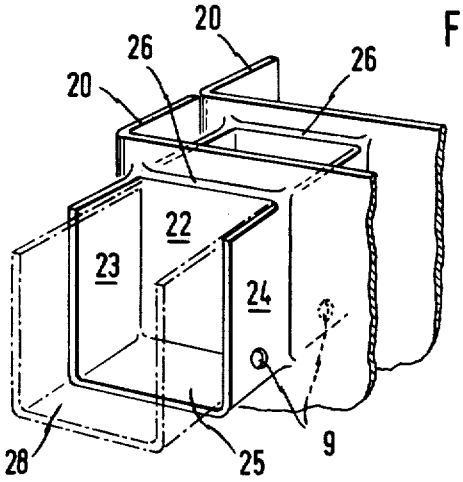

APPARATUS FOR SPRAYING TRICKLER PLATES WITH COOLING WATER

The present invention relates to an apparatus for spraying trickler plates with cooling water, in particular in cooling towers, the cooling water being pumped to a level above the trickler plates into distributor channels to be dispensed from above to the trickler plates through spray channels associated with the distributor channels and each having at least one outlet opening in the area of each trickler plate for application of the cooling water to the respective trickler plate.

When using such an apparatus in cooling towers of the size customary today, the height by which the water to be cooled must be pumped to the level of the distributor channels is more than 10 m. As great amounts of water must be pumped up, the energy requirement to overcome this distance is quite considerable.

In known apparatus there is a spacing between the outlet openings of the distributor channels and the upper edges of the trickler plates. This spacing which increases the pumping height still further was believed to be necessary in order to obtain uniform distribution over the entire trickler plate surface of the water issuing from the outlet nozzles of the distributor channels in downward direction.

It is already known (Swiss Pat. No. 520 309) to extend the trickler plate which is designed as a grate in upward direction by a vertical baffle plate. An outlet tube from the distributor channels disposed on top of the same is directed at an acute angle against the vertical baffle plate. It is the purpose of this baffle plate to guarantee uniform distribution of the water in a thin film across the trickler plate proper. Thus also in this known case a spacing (bridged in part by the baffle plate) is indispensable between the lower side of the distributor channels and the upper edge of the trickler plate proper hich is embodied by the grate.

It is further known to guarantee uniform spraying of the trickler plates by passing the cooling water from upwardly open spraying channels over dams on the upper end sections of trickler plates (DE-AS No. 2 402 181). Finally, an apparatus is known which comprises tubular, closed spraying channels provided in their bottoms with slots into which project the upper areas of trickler plates (DE-PS No. 461 944). This apparatus never attained any importance in practice because it is difficult to produce and the spraying channels cannot be cleaned.

It is the object of the instant invention to provide an apparatus of the kind specified initially which can be manufactured and assembled economically, avoiding a spacing between the lower ends of the distributor channels and the upper ends of the trickler plates. It is another object of the invention to provide an apparatus which will permit undisturbed and easy operation and simple cleaning of the spraying channels.

To meet these objects, it is provided in an apparatus of the kind specified initially that the spray channels are formed to be smoothly continuous, in that the spray channels touch or pass through the upper end sections of the trickler plates, and in that each trickler plate is provided in its upper area with a surface pattern for uniform distribution of the cooling water.

It is known to give trickler plates certain profiles or surface patterns in order to enlarge their heat transmitting area (DE-AS No. 22 50 912).

It is advantageous if the spray channels are open at the top because then they can be cleaned with great ease. Preferably, the spray channels pass through the upper areas of the trickler plates. In this context it is convenient to have a total of two spray channels passing through the corners of the trickler plates.

The spray channels may be formed by cutting openings and forming the lugs resulting from such cutting out of the trickler plates. The lugs are of such dimensions that they bridge the spacing to the adjacent trickler plate. The configuration, preferably in the shape of a U with smooth walls and an open top, makes it particularly easy to clean the spray channels. This configuration can be realized conveniently by forming two lateral lugs to constitute the side walls and one lower lug to constitute the bottom of a piece of channel extending between two trickler plates. This concept of the spray channel design is particularly advantageous if the trickler plates are made of plastics and interconnected by bonding the lugs formed to the rear wall of the adjacent trickler plate. However, on principle, the spray channel structure described may also be realized if the trickler plates are made of sheet metal.

At least in its upper area each trickler plate is inclined with respect to the vertical and provided with a surface pattern which distributes the water across the entire width of the trickler plate in order to obtain good distribution of the cooling water issuing from the outlet openings of the spray channels and being sprayed on the trickler plates. The surface pattern may be constituted by corrugations which are of W- or V-shape when viewed from the top. In the simplest case the surface pattern is constituted by depressions extending horizontally in straight lines or obliquely.

It is advantageous to have U-sections of metal or plastics extend through the aligned openings in the upper and lower areas, respectively, of the trickler plates. On the one hand, these U-sections facilitate the assembly when lining up the trickler plates and, on the other hand, they are a simple means of providing tightened channels.

If pure wet cooling is desired, it is advantageous to arrange the trickler plates in vertical direction, the outlet openings being so disposed that they each wet the front side of one trickler plate and the backside of the adjacent trickler plate. If, however, mixed dry-wet cooling (hybrid cooling) is desired, the trickler plates are arranged below the outlet openings at least with an inclination in their upper areas so that they will be wetted on one side only by water from the outlet openings.

Although the trickler plates may be inclined across their entire height at an acute angle with respect to the vertical, it is preferred for reasons of inner stability to have each trickler plate extend at an inclination in the upper area only, while it extends vertically in the lower area. Each trickler plate may be provided in its lower area with a surface pattern designed to pass the water towards lateral discharge channels. Like the spray channels, also the discharge channels may pass through the trickler plates and may be formed by cutting openings and forming lugs out of the trickler plates. In this manner the pumping distance becomes smaller also below the trickler plates because, contrary to the conventional spraying systems with which the cooling water falls down quite a difference in height, the water in this case is collected directly in the lower area of the trickler plates so that the difference in height of the open water levels at the top and at the bottom can be kept at a minimum.

In accordance with a further modification of the subject matter of the invention the spray channels according to the invention conveniently extend directly below and transversely of transverse distributor channels which feed the spray channels through openings at the intersections, while the discharge channels extend vertically below the spray channels and directly above transverse collecting channels. In this manner the spacing below the trickler plates is avoided and, in addition, the pumping distance becomes shorter.

In a particularly advantageous further development of the invention the upper end area of each trickler plate is designed as a drop separator. In this manner the drop separators are dispensed with which normally are provided in addition above the spraying installations of known apparatus.

The apparatus according to the invention embodies an integrated system of trickler plates and spray channels, if desired, also including the discharge channels and the drop separators, which system is easy to produce and to assemble as well as to service.

With all embodiments of the invention, the arrangement preferably is made such that there is practically no spacing between the lower sides of the distributor channels and the upper edges of the trickler plates and practically no spacing between the upper edges of the collecting channels and the lower edges of the trickler plates. This is particularly so if the spray channels and the discharge channels extend through the trickler plates themselves in accordance with the preferred embodiment of the invention. In spite of this arrangement uniform distribution of water across the trickler plates is guaranteed by the provision of the lateral openings in the spray channels and by the surface patterns mentioned in the upper and lower areas of the trickler plates. The elimination of the spacing permits a corresponding diminution of the pumping distance and thus of the pumping energy requirement. The elimination of the lower spacing between the trickler plates and the collecting channels provides another important advantage inasmuch as the splashing noise normally made by falling drops is avoided. This is also of great economic importance because of the high costs of noise prevention measures which otherwise may be required.

Finally, a significant advantage of the apparatus according to the invention resides in the fact that no drops are formed either in the distribution system or in the spraying system or in the collecting system. Thus the amount of water entrained by the air current is reduced from the beginning. Above all very small drops which may evaporate totally or in part before the conventional drop separator are not formed anywhere by hard impact. Such very small drops would leave residues, which may contain all the chemical or bacterial impurities and may pass the drop separator. This is highly undesirable from an environmental standpoint.

The invention will be described further, by way of example, with reference to the accompanying drawings, in which:

FIG. 5 is a perspective view of some trickler plates of a set of trickler plates, including spray channels and discharge channels extending through the corners of the trickler plates in transverse direction of the same;

FIG. 6 is an enlarged perspective view showing the configuration of a piece of spray channel between two adjacent trickler plates;

FIG. 7 is a vertical sectional view of two trickler plates according to the invention disposed behind each other;

FIG. 8 is a top plan view of a modified configuration of the lower part of a trickler plate according to the invention.

Figure 1:
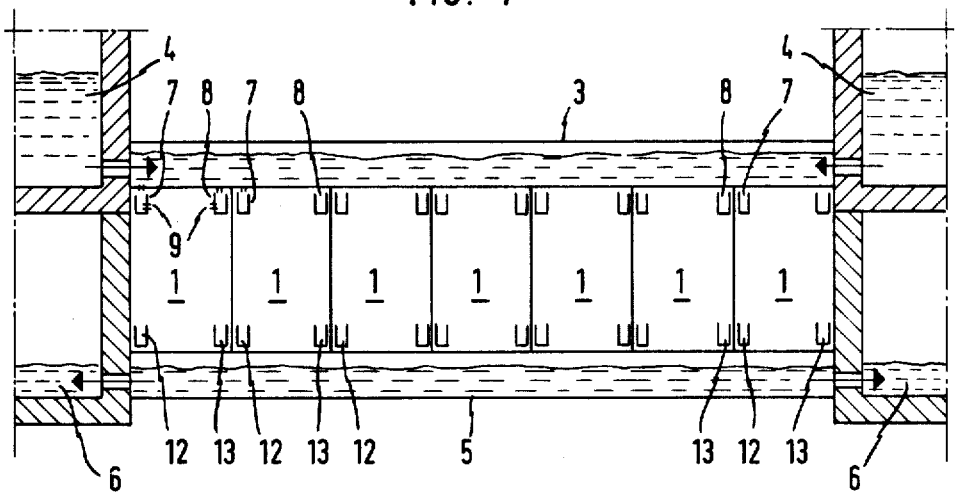
FIG. 1 is a diagrammatic front elevational view, partly in section, of a trickler plate arrangement, showing associated spray channels in transverse section and primary distributor channels feeding the same in longitudinal section.
Figure 2:
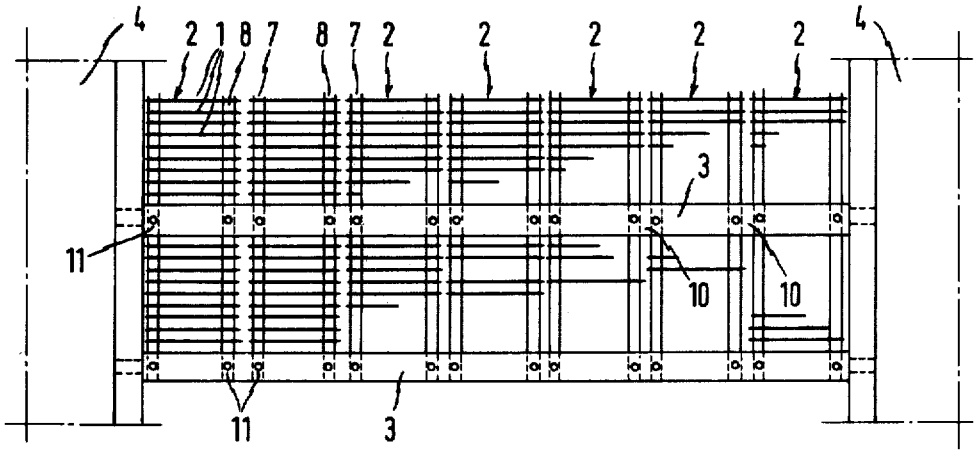
FIG. 2 is a top plan view of the arrangement according to FIG. 1.

FIG. 1 shows a series of aligned trickler plates 1 each belonging to a package or set of trickler plates 1 disposed in parallel with each other and designated in general by reference numeral 2 in FIG. 2. For reasons of simplicity FIGS. 1 and 2 show the trickler plates 1 as vertically disposed plates although they are inclined with respect to the vertical at least in partial areas, as follows from FIGS. 5 to 7.

As shown in longitudinal section in FIG. 1 and from the top in FIG. 2, a transverse distributor channel 3 each extends across all sets 2 of trickler plates 1. This transverse distributor channel extends between two primary distributor channels 4. A transverse collecting channel 5 catching water which runs down from the trickler plates extends between two primary collecting channels 6 below all sets 2 of trickler plates and vertically below the transverse distributor channel 3.

The transverse distributor chanels 3 are so disposed, that their underside is at the level of the upper edges of the trickler plates 1. Spray channels 7, 8 extend below those edges through the trickler plates in transverse direction of the transverse distributor channels 3 and thus also of the trickler plates 1. The spray channels 7 pass through the left upper edges of the trickler plates 1 and the spray channels 8 through the right upper edges of the trickler plates 1, as seen in FIGS. 1 and 2. The spray channels 7, 8 are U-shaped in cross section (FIG. 1) and open to the top and have lateral outlet openings 9 directed tangentially inwardly towards the trickler plates (see FIGS. 1, 5, 6, and 7). The water jets issuing from the openings flow in horizontal direction and tangentially to the trickler plates, distributing across the surface of the corresponding trickler plate (see FIGS. 6 and 7) from the outside toward the inside, starting from both plate edges, by virtue of a certain profile of the plate which will be described in greater detail below with reference to an example. In general, this profile may be obtained by unevenness produced in the plate surface. In the simplest case it is constituted by horizontal or oblique rectilinear bulges.

The spray channels 7, 8 are fed with water at intersections 10 through openings 11 provided in the bottom of the transverse distributor channel 3.

Discharge channels 12, 13 pass through the left lower corners and the right lower corners, respectively, of the trickler plates 1. These discharge channels extend in the same direction as the spray channels 7, 8 vertically below the same, and they are connected at the intersections to the transverse collecting channels 5 through discharge openings (not shown).

Figure 3:
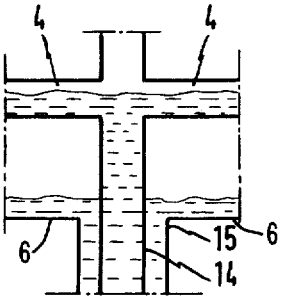
FIGS. 3 and 4 are vertical and horizontal sectional views, respectively, of an intersection at which primary distribution channels meet.
Figure 4:
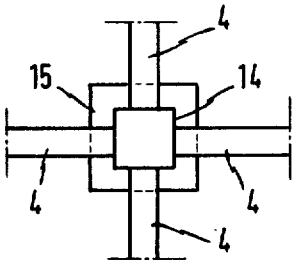

FIGS. 3 and 4 show the configuration of a junction at which a plurality of primary distributor channels 4 and primary collecting channels 6 meet. In the middle of the junction there is a central feedpipe 14 from which the main distributor channels 4 start which are disposed in a horizontal plane. The feedpipe 14 is surrounded by an annular collecting pipe 15 into which the primary collecting channels 6 open which are disposed below the primary distributor channels 4.

FIGS. 5 to 8 show embodiments of the trickler plates and spray channels in greater detail.

In the case of the embodiment according to FIG. 5, shown by continuous lines in cross section in FIG. 7, each trickler plate has a profile which includes, as seen in cross section, an uppermost, essentially vertical section 16, an upper inclined section 17 beginning approximately at the level of the outlet openings 9, a vertical section 18 joined to the lower end of section 17, and a lowermost discharging section 19 which again may be inclined at a small acute angle with respect to the vertical or which may also extend vertically, as indicated by dash double dot lines in FIG. 7.

The horizontal continuous bulge or overhanging section 16' seen in FIG. 7 serves as drop separator. It catches drops which air carries to the top so that also these drops may trickle down the surface of the trickler plates.

The inclined upper section 17 does not make sense unless only one-sided wetting of the trickler plates is intended so as to provide a system of mixed wet-dry cooling (dry cooling at the backside of the trickler plates which is not wetted). If, on the other hand, wetting on both sides is intended, in other words pure wet cooling is desired, it is convenient to have section 17 extend in vertical direction. The water jets issuing from the outlet openings 9 at the same time each wet the front side of one trickler plate and the backside of the other trickler plate. In this context a convenient profile or surface pattern will guarantee the uniform distribution of water at both sides of the plates.

According to an alternative in the case of one-sided wetting, the lower section 18 may be replaced by a section 18' having the same inclination as the upper section 17.

Successive trickler plates support each other along their lateral edges 20, 21 which are bent towards the back and, if desired, they may be connected to each other, e.g. by bonding or gluing. Each piece of channel between two adjacent trickler plates, i.e. of the spray channels 7, 8, and of the discharge channels 12, 13 is formed by cutting openings 22 and forming lugs 23, 24 to constitute the sidewalls of the piece of channel and lower lugs 25 to constitute the bottom of the respective piece of channel. These lugs are glued or otherwise fixed, e.g. welded to the backside of the next trickler plate around the opening 22 thereof. If plastic material is used, the lugs 23, 25 and 24, 25 are made in one piece by thermal deformation.

Each piece of channel of all the channels is open at the top as demonstrated in FIG. 6 by the bending of a narrow web 26 at the upper edge of the opening 22 serving merely for stiffening. The elongated spray channels 7, 8 according to FIG. 2 thus are formed by assembling trickler plates and connecting them in the manner described. The assembly is facilitated and, at the same time absolute tightness of the spray and discharge channels is obtained by the use of U-sections 28 on which the trickler plates 1 are simply threaded so as to form sets or packages.

In the upper areas the trickler plates are provided with corrugations 27 which are raised out of the surface in cross section and extend in W-shape towards the middle of the trickler plate 1, converging towards the bottom. The corrugations 27 provide even distribution of the cooling water flowing out of the outlet openings 9 across the working surfaces of the trickler plates.

The lower section 18 or 18' of the trickler plates 1 may be provided with corrugations 29 which are raised out of the surface in cross section yet disposed in opposite sense with their V-apices directed upwardly towards the center of the trickler plate 1. The free ends of the corrugations 29 terminate above the upwardly open discharge channels whereby the guiding effect of the corrugations 29 permits practically all of the water to reach the discharge channels 12, 13. FIGS. 5 and 7 show an alternative embodiment in which the corrugations 29 are replaced by horizontal grooves 30, the free ends of which, however, also terminate above the discharge channels 12, 13. The grooves 30 may also be inclined.

The design of the trickler plates as described and the forming of the spray channels out of the material of the trickler plates make it possible to effectively obtain uniform distribution of the water across the height of the trickler plates without having to provide the spray channels at a considerable level above the upper edges of the trickler plates 1. Moreover, the provision of the discharge channels 12, 13 in the lower corners of the trickler plates makes it possible to connect the collecting system without any spacing directly to the lower edges of the trickler plates. This means that the vertical spacing which used to be required in order to obtain uniform spraying of the cooling water and thus uniform wetting of the trickler plate surfaces can be dispensed with. This in turn amounts to considerable saving of pumping energy. The saving becomes greater still by additionally avoiding a spacing between the lower edges of the trickler plates and the collecting system. Preferably, the trickler plates shown are formed of plastic material and bonded together. Yet they may also be made of sheet metal, in which case they are welded or glued together. Even if made of sheet metal, the design and purpose of the lugs 23, 24, 25 is similar to the embodiment shown. Yet in this event square openings are formed by diagonal cuts and bending of triangular lugs. A composite structure of adjacent trickler plates 1 of a set 2 can be obtained by soldering or welding. Of course, also other means of connection are conceivable. In this case, too, the individual trickler plates may be threaded on U-sections fitting into and extending through the openings formed.

What we claim is:

1. Apparatus for spraying trickler plates with cooling water, which comprises:

a plurality of parallelly disposed trickler plates, each of which has a surface pattern formed in the upper surface thereof for uniform distribution of the water to be cooled; and means for distributing water to be cooled, said water distribution means including at least one water distribution channel extending above and parallel to said trickler plates, and at least one water spray channel disposed below said water distribution channel and transversely to said trickler plates, said water spray channel being formed by lugs, each of which at least partially surrounds the periphery of an opening formed in the upper portion of a respective trickler plate and extends outwardly from a surface thereof to bridge the spacing between adjacent trickler plates, said distribution channel having formed in the lower surface thereof at least one opening positioned at the intersection of said distribution channel and said spray channel, said spray channel having an open upper surface to receive water distributed by said distribution channel and gravitating through said distribution channel opening, said spray channel having a plurality of outlet openings formed in at least one lateral side thereof and directed tangentially toward said trickler plates, each outlet opening being positioned in close proximity to the upper surface of a corresponding trickler plate to provide said surface with said water to be cooled.

2. The apparatus as claimed in claim 1, characterized in that the trickler plates (1) are made of plastics and in that the lugs (23, 24, 25) formed out of the trickler plates are bonded to the rear wall of the adjacent trickler plate and to each other.

3. The apparatus as claimed in claim 1 or 2, characterized in that each trickler plate (1) is inclined in its upper area (17) and extends vertically in its lower area (18).

4. The apparatus as claimed in claim 1, characterized in that each trickler plate is provided in its lower area with a surface pattern (29) for guiding the water towards lateral discharge channels (12, 13).

5. The apparatus as claimed in claim 4, characterized in that also the discharge channels (12, 13) pass through the trickler plates (1) and are formed by cutting openings and forming lugs out of the trickler plates.

6. The apparatus as claimed in claim 1, including trickler plates which are arranged parallel to one another in sets, characterized in that the trickler plates (1) of a set are slid on and pushed against one another on U-sections (28) fittingly passing through the openings (22) formed out of the trickler plates, the upwardly open U-sections consituting the respective channels (7, 8; 12, 13).

7. The apparatus as claimed in claim 1, characterized in that the upper end area of each trickler plate (1) is formed as a drop separator (16').

* * * * *